US009392369B2

(12) United States Patent
Gerkinsmeyer

(10) Patent No.: US 9,392,369 B2
(45) Date of Patent: Jul. 12, 2016

(54) SPEAKER HAVING CENTER PLEAT

(76) Inventor: Norman Gerkinsmeyer, Neu-Ulm (DE)

( * ) Notice: Subject to any disclaimer, the term of this patent is extended or adjusted under 35 U.S.C. 154(b) by 151 days.

(21) Appl. No.: 13/376,404

(22) PCT Filed: Nov. 4, 2009

(86) PCT No.: PCT/EP2009/007893
§ 371 (c)(1),
(2), (4) Date: Dec. 6, 2011

(87) PCT Pub. No.: WO2010/142315
PCT Pub. Date: Dec. 16, 2010

(65) Prior Publication Data

US 2012/0087523 A1 Apr. 12, 2012

(30) Foreign Application Priority Data

Jun. 8, 2009 (DE) ..... 10 2009 024 566

(51) Int. Cl.

| | |
|---|---|
| ***H04R 25/00*** | (2006.01) |
| ***H04R 7/16*** | (2006.01) |
| ***H04R 9/04*** | (2006.01) |
| *H04R 7/06* | (2006.01) |
| *H04R 9/02* | (2006.01) |

(52) U.S. Cl.
CPC ..... *H04R 7/16* (2013.01); *H04R 9/043* (2013.01); *H04R 7/06* (2013.01); *H04R 9/025* (2013.01); *H04R 2209/022* (2013.01); *H04R 2307/204* (2013.01); *H04R 2307/207* (2013.01); *H04R 2499/13* (2013.01)

(58) Field of Classification Search
CPC .. H04R 9/025; H04R 2209/022; H04R 9/046; H04R 9/06; H04R 2209/041; H04R 2499/13; H04R 7/02; H04R 7/122; H04R 7/127; H04R 9/063; H04R 1/06; H04R 2307/029; H04R 31/006; H04R 5/02; H04R 7/04; H04R 7/06; H04R 7/12
USPC ..... 381/392, 396, 398, 403, 412, 421, 422, 381/423, 430, 431; 181/167, 172, 174
See application file for complete search history.

(56) References Cited

U.S. PATENT DOCUMENTS 4,132,872 A * 1/1979 Inoue ..... 381/424
4,351,411 A * 9/1982 Inoue ..... 181/168
(Continued)

FOREIGN PATENT DOCUMENTS

EP 942626 A2 * 9/1999 ..... H04R 9/06

*Primary Examiner* — Davetta W Goins
*Assistant Examiner* — Phylesha Dabney
(74) *Attorney, Agent, or Firm* — Hayes Soloway P.C.

(57) ABSTRACT

A speaker includes a basket, a membrane system with a sandwich-like membrane that becomes thicker from the outside inwards, an oscillation coil mounted in the center and at the level of the membrane on a support. A first centering centers the membrane in the basket in a first plane, and a second centering connected with the support centers the membrane in a second plane via the support. A symmetrically designed stray field magnet system with two magnets with opposingly-oriented poles and a pole plate are centrally placed between the magnets. The stray field magnet system centrally penetrates the membrane, the oscillation coil is at the level of the pole plate in its non-deployed state, and the stray field magnet system is situated in centered fashion to the basket. A centered lip forms a closed and flexible connection between the stray field magnet system and the membrane system.

16 Claims, 3 Drawing Sheets

(56) References Cited

U.S. PATENT DOCUMENTS 5,668,886 A * 9/1997 Sakamoto et al. ..... 381/412
5,818,950 A * 10/1998 Sakamoto et al. ..... 381/420
6,259,800 B1 * 7/2001 Tagami ..... 381/412
6,768,806 B1 * 7/2004 Button et al. ..... 381/401
6,847,726 B2 * 1/2005 Button et al. ..... 381/401

* cited by examiner

SPEAKER HAVING CENTER PLEAT

BACKGROUND OF THE INVENTION

The invention related to a speaker comprising a basket, a flat membrane and a stray-field magnet system, the designed height of which is as small as possible.

Fundamentally such speakers are generally known. They are used predominantly in the consumer products, pro audio, installed-unit and automotive areas on land, water and in the air, and should be mounted, integrated or installed with a minimum of space and materials.

However, a problem exists in that such speakers are not designed to be flat enough, and on the other hand also have unsatisfactory sound quality, especially in the bass range, since these two requirements are mutually exclusive.

Therefore the task of the invention is to find a structure of as flat a speaker as possible while simultaneously optimizing sound quality, especially in the bass range.

This problem is solved through the features of the independent patent claim 1. Advantageous additional embodiments of the invention are the subject of the subordinate claims.

To hear, perceive or even detect the bass correctly, surface and carrier frequency alteration or amplitude are needed. If the surface becomes smaller in relation, more alteration is needed. This "more alteration," i.e. more membrane motion, requires space, and, as described previously, in most installation situations there is likely to be less space. A possibility exists of active rectification, meaning electronic engagement with DSP technology, but this also does not alter the facts of physical laws.

SUMMARY OF THE INVENTION

The inventor has recognized that it is possible to design a speaker that has a minimum of structural height on the one hand, and on the other hand delivers optimal sound-quality result, especially in the bass range.

Accordingly for such a speaker, a very stiff membrane with a sandwich structure is used, which thereby can be configured to be very flat. For generation of maximum carrier frequency alteration, a symmetrical stray field magnet system is used, wherein the membrane is connected via a hollow-cylindrical support with an oscillation coil situated within. To avoid undesired tumbling movement in two planes, the membrane is guided by two centerings, with a first centering tensioned directly between basket and membrane and a second centering between basket and support. In addition, to achieve sufficient sound quality with this structure, it is absolutely necessary to employ a central lip, which effectively prevents penetration of air between the stray field magnet system and the oscillation coil, thus sealing this gap, or covering residual blur arising there.

The invention is a flat-structured speaker with a central lip and a speaker chassis with a symmetrical stray field.

In terms of its structure, this type of speaker as a rule is a relatively open, non-airtight speaker system. What is meant is that the oscillation coil only in the center surrounds the magnet, which is configured like a more or less simple cylinder. By this means an annular air gap forms between the interior of the coil and the outer side of the magnetic cylinder.

If the speaker is mounted in a housing and the membrane moves with the coil, through this air gap the air can pass unhindered on the one hand and generate noises that derive from the decompression and compression of the air, and on the other hand noise can be generated through the mechanics of the acoustic converter itself and become audible without attenuation to the speaker housing.

The lip used in the speaker configured according to the invention, placed in the middle of the speaker and extending out from the central magnet system (=centered lip) should prevent this problem for one thing and in addition the acoustic short circuit that occurs between the front and rear side of the membrane, is curtailed. For this purpose, the centered lip is now mounted, glued or clamped in centric or rotationally symmetric fashion with the magnet, with its optional adapter or spacer piece or other auxiliary media and the surrounding membrane with its optionally present adapter or spacer piece or other auxiliary media.

However, it has also been shown to be favorable to design the centered lip so that it also has guiding or centering and also damping properties. Depending on the task, it is very significant what material is selected.

If it is to also provide damping, then a damping rubber, caoutchouc, or plastic should be used; if instead it should provide centering, an airtight coated weave is advantageous; if it should have only a sealing function, compressed foam has been shown to be very positive. However, it is also conceivable that the materials could be used in mixed or combined fashion, for example a fabric coated with rubber, caoutchouc or plastic or vulcanized, etc.

It has also proved favorable to attain various functions and properties through shaping the contour of the centered lip. Thus it is advantageous to configure the edges or ends with which the centered lip is secured, especially glued on, to rather be straight or thicker, in order to have more stability. At the same time the radius itself should have a thinner shape, since it must be able to move purposefully. It can also be advantageous to configure a gradual transition from the edges or ends to the radius itself in thickness and flexibility, to make possible a harmonic unwinding or movement.

In accordance with this knowledge described above, the inventor proposes a speaker with a sound radiation direction, with

- a basket,
- a membrane system with:
  - a sandwich-like membrane that becomes thicker from the outside inwards,
  - an oscillation coil that is mounted in the center and at the level of the membrane on a support, and wound inwards, with the membrane being connected with the support,
  - a first centering, especially one with a sinusoid shape in cross section, which centers the membrane in the basket in a first plane,
  - a second centering, especially one with a sinusoid shape in cross section, which is connected with the support of the oscillation coil and centers the membrane in a second plane via the support,
- a symmetrically designed stray field magnet system with two magnets with opposingly-oriented poles and a pole plate centrally placed between the two magnets, wherein:
  - the stray field magnet system centrally penetrates the membrane,
  - the oscillation coil is at the level of the pole plate in its non-deployed state,
  - and the stray field magnet system is situated in centered fashion to the basket,
- and a centered lip, which forms a closed and flexible connection between the stray field magnet system and the membrane system.

There exists a fundamental possibility to connect the oscillation coil which has two contacts, with an amplifier via free wires; but it is more favorable if the electric contacts in their course are connected with a centering, especially placed symmetrically and preferably interwoven with the centering. By this means there arise no undefined and asymmetric forces that could unfavorably affect the motion of the oscillation coil and thus of the membrane.

Additionally, it is especially favorable if the centered lip is placed on the main radiating side of the speaker.

Besides that, the centered lip should exhibit a maximum radius that at most is a third of the maximum radius of the membrane, so that no disturbances arise from the centered lip itself.

It is also advantageous to configure the contour and/or thickness of the material of the centered lip so that it varies in thickness over its body. By this means, in areas that should have a particularly stable shape, relatively more material is used, and in areas that should be especially elastic, there should be savings in material thickness. With this, the contour or material thickness should make a soft and/or gradual transition between differing thicknesses.

It is favorable if the centered lip displays a contour that makes a graduated transition from thick on the lower outer edge and adhering surface to thinner over the radius and then thicker again to the upper inner diameter and adhering surface.

The centered lip can be manufactured for example from a pressed foam or from a mixed form of the materials as per the following list: caouchouc, plastic, air-tight coated materials.

Additionally, the centered lip can be installed with the aid of a spacer piece. It is also favorable if the centered lip is a one-piece design.

Additionally, the stray field magnet can be so configured that at at least one side it exhibits a phase or a section in the area of the rear side. The centered lip can then be attached in very space-saving fashion as regards structural height.

The centered lip itself can be placed on the side of the membrane and connected directly with it. Alternatively, there is a somewhat less favorable, but still sufficiently effective option of connecting the centered lip directly with the second centering.

A spraying process or a vulcanizing process can be used for manufacturing the centered lip.

Additionally, the basket can be provided with openings that allow air to pass through, thus preventing air stagnation. These openings in the basket can in addition be provided with an acoustically and/or air penetrable material or fabric for protection from dust, dirt and water.

At least one of the centerings can be designed as a can centering and/or have a spacer disk for easier assembly.

To homogenize the progression of field lines and improve field strength above and below the stray field magnet system, additionally a disk of magnetic material can be placed. For this it can also be advantageous if a thin copper ring or a copper beaker is placed about the outer edge of the pole plate. Likewise the basket can be made of a non-magnetic material.

Additionally there exists an option to facilitate the installation of the speaker by providing the individual parts of the stray field magnet system, i.e. the magnets and pole plate, with a central borehole, through which for facilitating mounting a non-magnetizable screw can be guided, which is removed after mounting.

Additionally, it can be manufactured by placing a part of the speaker in an object to be integrated, for example the door panel of a motor vehicle, and then during assembly the other missing parts are mounted onto it.

Regarding the configuration of the sandwich-type configured membrane, it is favorable if it becomes thicker from the outer edge approaching the middle, preferably in a constantly straight or constantly curved form.

Fundamentally it is advantageous to embody the membrane to be as flat as possible to save structural height. For this, advantageously the membrane should have a rotationally symmetric shape and have a conical opening angle of 80° to 95° between rotational axis and conical opening related to its surface directed to the main direction of radiation. If the membrane is not rotationally symmetric, the opening angle described should likewise not be exceeded.

Alternatively, with a membrane having a rotationally symmetric shape, related to its bilateral surfaces, a conical opening angle of 90° to 95° between the axis of rotation and the conical surface can be provided. Here also it holds true: if the membrane is not rotationally symmetric, the opening angle described should likewise not be exceeded.

For a design as compact as possible, the membrane can have an inner hollow-cylinder edge, which is connected with the support of the oscillation coil, wherein the membrane relative to its inner hollow-cylinder edge in the direction of carrier frequency alteration of the oscillation coil can be arranged to be symmetric to the oscillation coil or relative to its inner hollow-cylinder edge in the direction of carrier frequency alteration of the oscillation coil be offset on one side to the oscillation coil, but can be placed in the area of the oscillation coil.

Additionally, in advantageous fashion, the support of the oscillation coil configured as a hollow cylinder could be of a greater height than the inner hollow-cylindrical edge of the membrane, with the support of the oscillation coil advantageously projecting on one side considerably farther out from the inner edge and there being connected with the second centering.

Besides the above-described optimized configuration of the stray field magnet system and its placement in relation to the basket and the membrane, additionally the shape and configuration make a considerable contribution to the invention-specific flat design of the speaker. Especially the membrane should be configured as a sandwich to attain a very stable structure, with it being especially favorable if the membrane runs flat relative to its central plane or related to the sections shown here of its midline between its exterior surfaces, thus having a conical opening angle of 90°. Related to a membrane that becomes thinner approaching the edge, the conical opening angle then amounts to even more than 90°, possibly up to 95°. It is true that fundamentally there also exists a possibility to give the membrane a slightly arched shape in the direction of its main sonic radiation. Related to a cone, with this, conical opening angles up to 80° can be implemented. However, as soon as the outer edges of the membrane with their membrane project out when reaching their maximum travel over the arching of the centering lip, this produces an undesired increase in the constructive height of the speaker.

BRIEF DESCRIPTION OF THE DRAWINGS

In what follows, the invention is described in greater detail with the aid of the preferred embodiment examples, using the figures, with only the necessary features depicted for understanding the invention.

Shown in particular are.

DETAILED DESCRIPTION OF THE INVENTION

Figure 1:
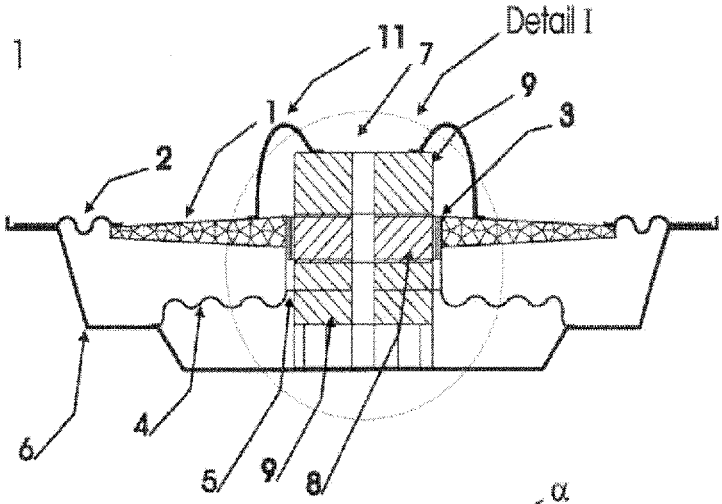
FIG. 1: An invention-specific speaker with an interior-wound oscillation coil with a support for the oscillation coil, a lip, a flat sandwich membrane, a basket, a flat centering, an annular air gap with an air aperture and a symmetrical stray field magnet with its pole plate; the centered lip is indicated only by dashes.

FIG. 1 shows a speaker whose frequency extends into the bass range, with an interior-wound oscillation coil on a cylindrical oscillation coil support 3, with a first centering or lip 2, a membrane 1 that runs flat to level and is configured to be sandwich-like, a basket 6, a second centering 4 and an annular air gap 5 between the oscillation coil or the oscillation coil support and a symmetrical stray field magnet system 7. The stray field magnet system 7 consists of a centrally situated pole plate 8 and magnets 9 attached over and under it. According to the invention, the air gap 5 is covered and closed by a schematically drawn centered lip 11, which is attached between the stray field magnet system 7 and the membrane system consisting of membrane 1, oscillation coil support 3 and second centering 4. Here the centered lip is attached on upper magnet 9 and on membrane 1 itself. A detail 1 with stray field magnet system 7 is surrounded by a circle.

Figure 2:
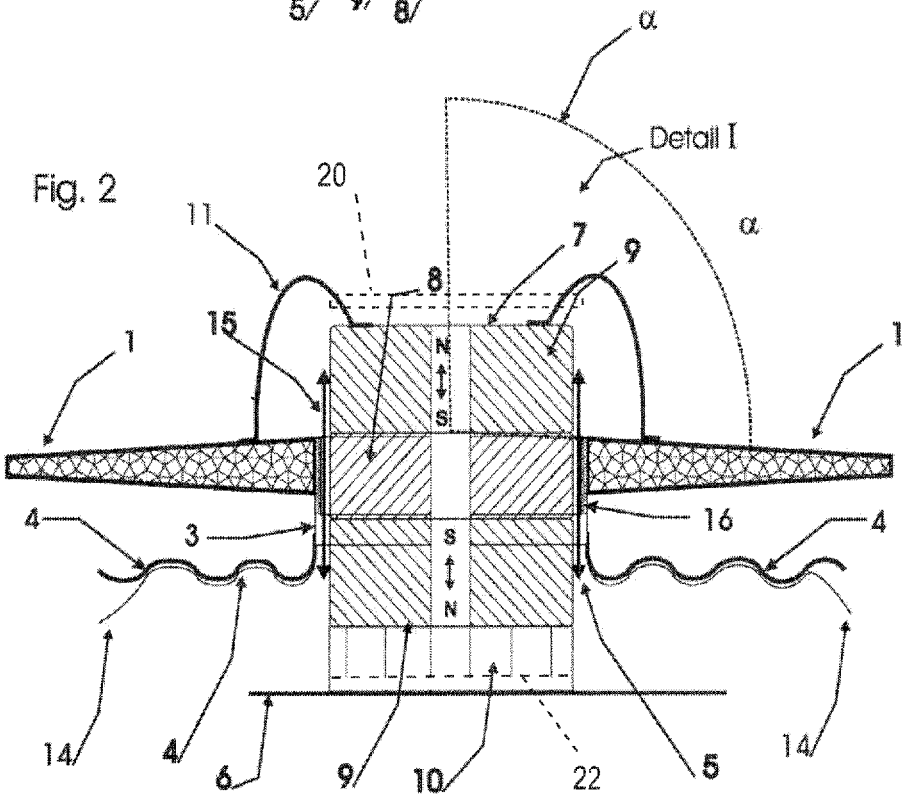
FIG. 2: Detail I from FIG. 1 with an interior-wound oscillation coil with an oscillation-coil support, with a lip, with a flat sandwich membrane, a basket, flat centering and a symmetrical stray field magnet system consisting of two magnets mounted to have opposing poles with a pole plate in between, a spacer piece for assembly and the annular air gap which through its arrows designates the direction of air passage.

FIG. 2 shows Detail I from FIG. 1, with the oscillation coil 16 wound in the interior in the oscillation coil support 3 and with the first centering 2, with flat sandwich membrane 1, basket 6, second centering 4 and symmetrically configured stray field magnet system 7, consisting of two magnets 9 mounted with opposing poles, with a pole plate 8 situated situated between them. Beneath on the magnet system a spacer piece 10 is situated, which also facilitates assembly. Especially perceptible in this detailed depiction, is the annular air gap 5 between the oscillation coil support or oscillation coil and the stray field magnet system, through which air, during a carrier-frequency-alteration motion of membrane 1, can flow in air passage direction 15, and—if no countermeasures are present—can cause blur noises. To avoid such blur noises, the invention-specific speaker has a centered lip 11, here depicted only schematically, that seals and covers this air gap 5.

Additionally perceptible in FIG. 2 is that the line leads 14 are symmetrically connected with second centering 4, on its underside, so that no unilateral mechanical influences can be exerted by these electrical connections 14.

Additionally FIG. 2 shows the wedge opening angle $\alpha$ between the axis of symmetry and the surface of membrane 1 directed forward.

Figure 3:
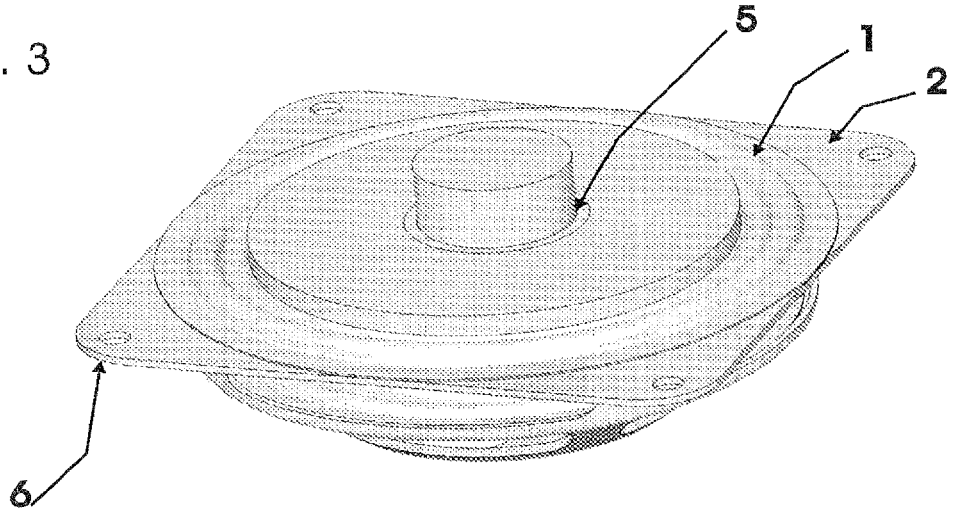
FIG. 3: A speaker from FIG. 1 with no centered lip in a 3D view, to better illustrate the annular air gap with an air passage.

FIG. 3 shows the speaker from FIG. 1 in a 3D view, in fact for a better view of the air gap on the magnet system with no centered lip.

Figure 4:
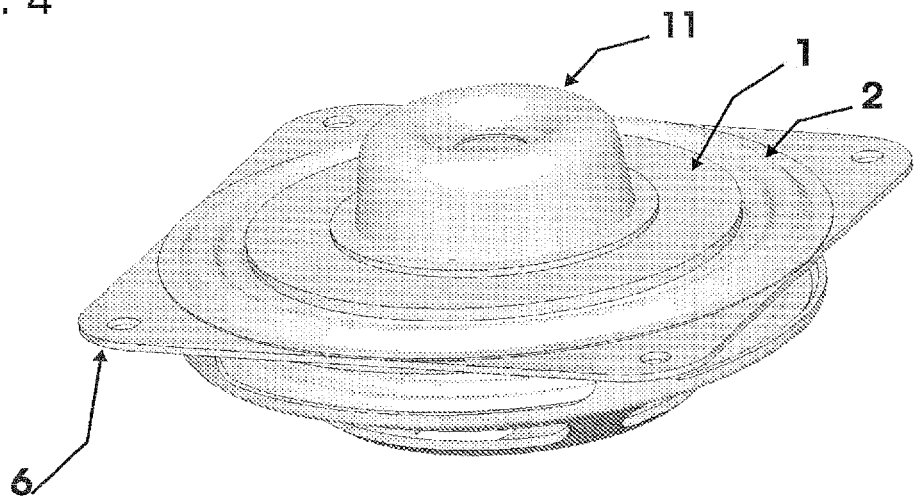
FIG. 4: An invention-specific speaker with a one-piece basket structure in a 3D view, on which, in a simplified depiction, a cylindrical symmetrical stray field magnet and the membrane is mounted, to cover or seal the annular air gap with an air passage.

FIG. 4 shows the speaker with a one-piece basket design from FIG. 1 in a 3D view, wherein here the invention-specific centered lip 11 is mounted on the stray field magnet system in a simplified depiction and on membrane 1. By this means, the annular air gap with its air passage is covered or sealed. Thus blur noises, or propagation of them, are avoided, by centered lip 11.

Figure 5:
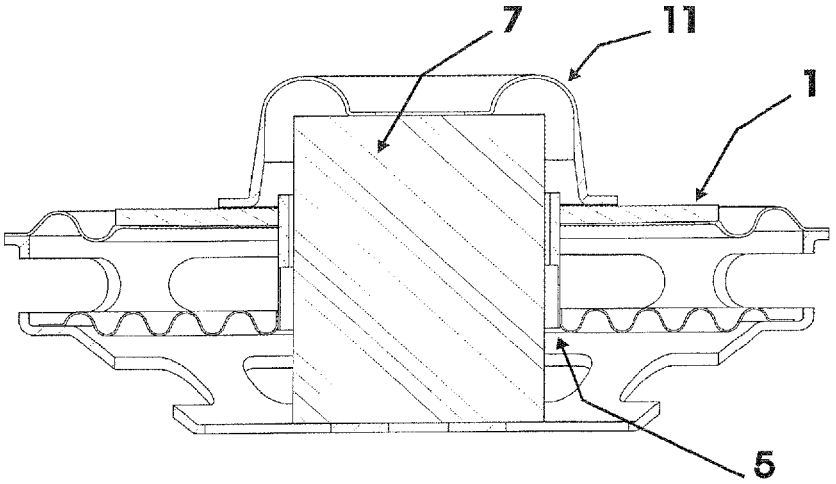
FIG. 5: A speaker with a one-piece basket structure in a sectioned view, on which the centered lip is mounted on the cylindrical symmetrical stray field magnet depicted in simplified fashion, and thus covers or seals the annular air gap with air passage.

FIG. 5 shows an exemplary invention-specific speaker, here with a one-piece basket design, in a sectioned view, on which the centered lip 11 is mounted on the cylindrical and symmetric stray field magnet system 7, depicted in simplified fashion, and membrane 1, and which thus covers or seals the annular air gap with air passage 5. Here and in all the other figures, stray field magnet system 7 in its design matches the depictions from FIGS. 1 and 2. Here, membrane 1 is designed as a simple flat sandwich membrane, but also, in an improved version, it can correspond to the membrane from FIG. 1 that tapers down in cross section.

Figure 6:
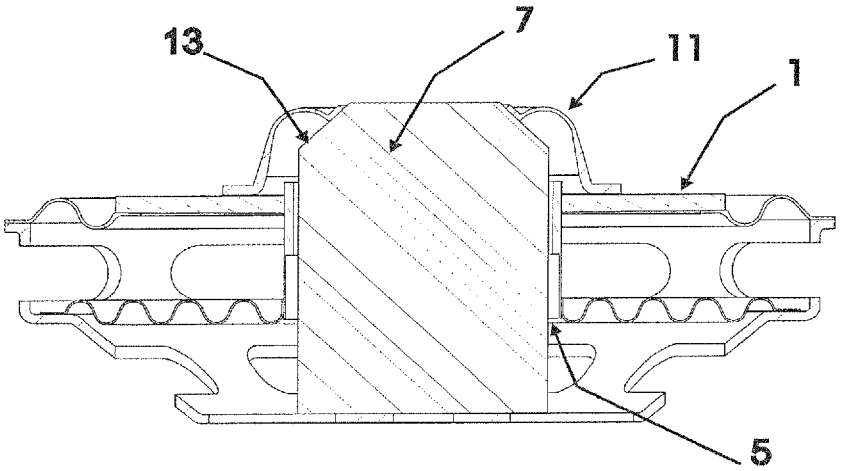
FIG. 6: A speaker with a one-piece basket structure in its sectioned view, on which the centered lip is mounted on the cylindrical symmetrical stray field magnet depicted in simplified fashion, wherein the stray field magnetic system exhibits a wide phase on which the centered lip is attached.

FIG. 6 shows the speaker with a one-piece basket construction in a sectioned view, on which the centered lip 11 is mounted on the cylindrical and symmetric stray field magnet system 7, depicted in simplified fashion. Here, to cut down on structural height, the upper magnet of the stray field magnet system 7 is equipped with a slanted phase 13, on which centered lip 11 is attached in space-saving fashion, so that it does not project out over the level of the magnet system. As an alternative to the slanted phase 13 depicted here, also a recess can be made in the magnets on which the centered lip is attached.

Figure 7:
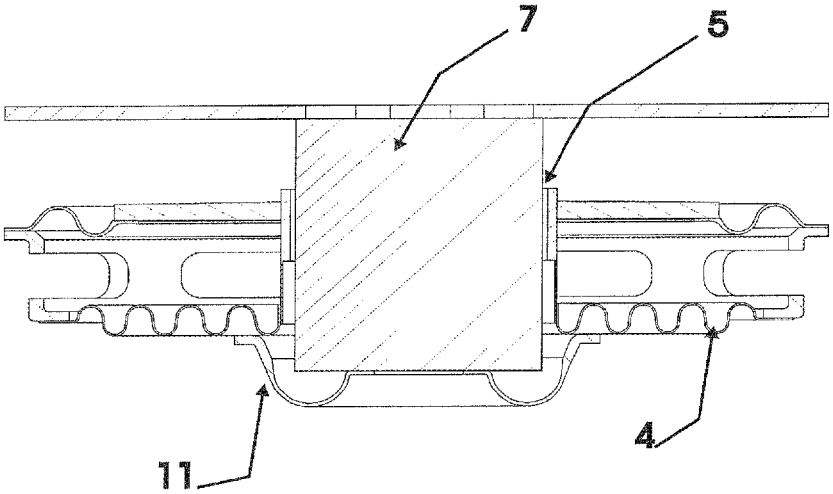
FIG. 7: A speaker with a multi-piece basket structure in a sectioned view with a design reverse to that of FIG. 6, wherein the centered lip is mounted on the lower side of the cylindrically shaped stray field magnet, placed against the main direction of radiation.

FIG. 7 shows the invention-specific speaker with a multi-part basket structure in a sectioned view. In contrast to FIGS. 1 to 6, in which there existed a main radiation direction away from the basket, here the main radiation direction points in the direction of the basket, so that the design is reversed. Therefore, in this example the centered lip 11 is placed from below on the cylindrical symmetrical stray field magnet system 7, depicted in simplified fashion, and on the second centering 4.

It is noted that all of the speakers depicted here have an upward main radiation direction.

Figure 8:
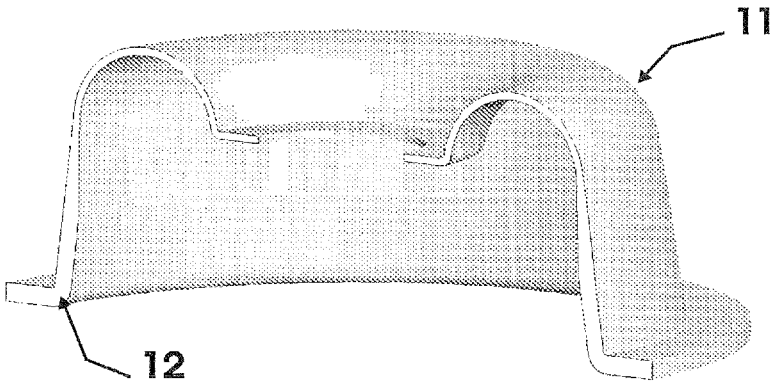
FIG. 8: A centered lip in section in a 3D view with a contour and material thickness that varies.

Lastly, FIG. 8 shows a centered lip 11 in cross section with a 3D view. In this depiction, the varying-thickness contour 12 of the material is especially easy to perceive.

It has also been shown to be favorable to design centered lip 11 so that it also has guiding or centering and also damping properties. Depending on the task, it is very significant what material is selected. If it is to also provide damping, then a damping rubber, caoutchouc, or plastic should be used; if instead it should provide centering, an airtight coated weave is advantageous; if it should have only a sealing function, compressed foam has been shown to be very positive.

However, it is also conceivable that the materials could be used in mixed or combined fashion, for example a fabric coated with rubber, caoutchouc or plastic or vulcanized.

It has also proved favorable to attain various functions and properties through shaping the contour of the centered lip. Thus it is advantageous to configure the edges or ends with which the centered lip is glued or secured, to rather be straight or thicker, in order to have more stability, while the radius itself should have a thinner shape, since it must be able to move deliberately. It can also be advantageous to make a gradual transition from the edges or ends to the radius itself in thickness and flexibility, to make possible a harmonic unwinding or movement.

Thus overall with the invention, a very compact and especially flat design of speaker is proposed which is especially suited for installation in low-depth consoles, without having to dispense with outstanding sound quality, especially in the bass range.

It is understandable that the above-named features of the invention can be used not only in the combination indicated previously, but rather also in other combinations, without departing from the compass of the invention. Especially the combinations of features described in what follows appear to be particularly favorable:

I. Speaker with a sound radiation direction, with

I.I. a basket (6),

I.II. a membrane system with:

I.II.I. a sandwich-like membrane (1) that becomes thicker from the outside inwards, I.II.II. an oscillation coil (16) that is mounted in the center and at the level of the membrane (1) on a support (3), and wound inwards, with the membrane (1) being connected with the support (3), I.II.III. a first centering (2), especially one with a sinusoid shape in cross section, which centers the membrane (1) in the basket (6) in a first plane, I.II.IV. a second centering (4), especially one with a sinusoid shape in cross section, which is connected with the support (3) of the oscillation coil (16) and centers the membrane in a second plane via the support (3), I.III. a symmetrically designed stray field magnet system (7) with two magnets (9) with opposingly-oriented poles and a pole plate (8) centrally placed between the two magnets, wherein:

I.III.I. the stray field magnet system (7) centrally penetrates the membrane (1), I.III.II. the oscillation coil (16) is at the level of the pole plate (8) in its non-deployed state, I.III.III. and the stray field magnet system (7) is situated in centered fashion to the basket (6), I.IV. and a centered lip (11), which forms a closed and flexible connection between the stray field magnet system (7) and the membrane system (1, 3, 16).

II. Speaker according to the foregoing combination I of features, wherein the oscillation coil has two electric contacts which in their course are connected with one of the centerings (2, 4).

III. Speaker according to the foregoing combination II of features, wherein the two electric contacts (14) are interwoven with one of the centerings (2, 4).

IV. Speaker according to one of the foregoing combinations I to III of features, wherein the centered lip (11) is placed on the main radiation side of the speaker.

V. Speaker according to one of the foregoing combinations I to IV of features, wherein the centered lip (11) has a maximum radius that is at most a third of the maximum radius of the membrane.

VI. Speaker according to one of the foregoing combinations I to V of features, wherein the centered lip (11) has a contour and/or a material thickness that varies.

VII. Speaker according to the foregoing combination VI of features, wherein the contour or material thickness makes a soft and/or gradual transition in thickness.

VIII. Speaker according to one of the foregoing combinations I to VII of features, wherein the centered lip (11) is manufactured from a compressed foam.

IX. Speaker according to one of the foregoing combinations I to VIII of features, wherein the centered lip (11) is assembled with the aid of spacer pieces (10).

X. Speaker according to one of the foregoing combinations I to IX of features, wherein the centered lip (11) is manufactured in one piece.

XI. Speaker according to one of the foregoing combinations I to X of features, wherein the stray field magnet (7) on at least one side has a phase (13) or a projection on the front side, on which the centered lip (11) is attached.

XII. Speaker according to one of the foregoing combinations I to XI of features, wherein the centered lip (11) consists of a mixed form of materials from the following list: caoutchouc, plastic, air-tight coated materials.

XIII. Speaker according to one of the foregoing combinations I to XII of features, wherein the centered lip (11) is connected directly with the membrane (1).

XIV. Speaker according to one of the foregoing combinations I to XII, whereby the centered lip (11) is connected directly with the second centering (4).

XV. Speaker according to one of the foregoing combinations I to XIV of features, wherein the centered lip (11) has a contour (12) that gradually goes from thick on the lower outer edge and adhesive surface, to thinner over the radius and then again to thicker toward to upper inner diameter and adhesive surface.

XVI. Speaker according to one of the foregoing combinations I to XV of features, wherein the centered lip (11) is manufactured in a spraying procedure.

XVII. Speaker according to one of the foregoing combinations I to XV of features, wherein the centered lip (11) is manufactured in a vulcanizing process.

XVIII. Speaker according to one of the foregoing combinations I to XVII of features, wherein a thin copper ring or copper beaker is attached around the outer edge of the pole plate (8).

XIX. Speaker according to one of the foregoing combinations I to XVIII of features, wherein the basket (6) is provided with openings.

XX. Speaker according to the foregoing combination XIX of features, wherein openings in the basket (6) is provided with a material or fabric permeable by sound and/or air.

XXI. Speaker according to one of the foregoing combinations I to XX of features, wherein at least one of the centerings (2, 4) is a cup centering.

XXII. Speaker according to one of the foregoing combinations I to XXI of features, wherein at least one of the centerings (2, 4) has a spacer washer.

XXIII. Speaker according to one of the foregoing combinations I to XXII, wherein for homogenization of the field-line progression and for improvement of the field strength, washers shown in phantom in FIG. 2 at 20, 22, made of magnetic material are additionally placed above and below the stray field magnet system (7).

XXIV. Speaker according to one of the foregoing combinations I to XXIII of features, wherein the basket (6) consists of a nonmagnetic material.

XXV. Speaker according to one of the foregoing combinations I to XXIV of features, wherein the individual parts of the stray field magnet system (magnets and pole plate)

have a centered borehole to facilitate assembly with the aid of an unmagnetizable screw.

XXVI. Speaker according to one of the foregoing combinations I to XXV of features, wherein the manufacture occurs by placing a part of the speaker into the article to be integrated and the other missing parts are mounted thereto.

XXVII. Speaker according to one of the foregoing combinations I to XXVI of features, wherein the membrane (1) becomes thicker from the outer edge toward the middle, preferably constantly straight or in a constantly curved shape.

XXVIII. Speaker according to one of the foregoing combinations I to XXVII, wherein the membrane (1) is shaped to be rotationally symmetric and has a conical opening angle of 80° to 95° between rotational axis and conical opening related to its surface directed to the main direction of radiation.

XXIX. Speaker according to one of the foregoing combinations I to XXVII of features, wherein the membrane (1) has a rotationally symmetric shape, and, related to its bilateral surfaces, a conical opening angle ($\alpha$) of 90° to 95° between the axis of rotation and the conical surface.

XXX. Speaker according to one of the foregoing combinations I to XXIX of features, wherein the membrane (1) has an inner hollow-cylindrical edge which is connected with the support of the oscillation coil.

XXXI. Speaker according to the foregoing combination XXX of features, wherein the membrane (1) related to its inner hollow-cylindrical edge is situated symmetric to the oscillation coil (16) in the direction of carrier frequency alteration of the oscillation coil (16).

XXXII. Speaker according to the foregoing combination XXX of features, wherein the membrane (1) related to its inner hollow-cylindrical edge is situated at a unilateral offset to the oscillation coil (16) in the direction of carrier frequency alteration of the oscillation coil (16), but in the range of the oscillation coil (16).

XXXIII. Speaker according to one of the foregoing combinations XXX to XXXII of features, wherein the support (3) configured as a hollow cylinder of the oscillation coil (16) has a greater height than the inner hollow-cylinder edge of the membrane (1).

XXXIV. Speaker according to the foregoing combination XXXIII of features, wherein the support configured as a hollow cylinder of oscillation coil (16) projects considerably farther out on one side from the inner edge and is there connected with the second centering.

LIST OF REFERENCE SYMBOLS

1 membrane
2 lip
3 support for oscillation coil
4 centering
5 air gap
6 basket
7 stray field magnet system
8 Pole plate
9 magnets
10 spacer piece for assembly
11 centered lip
12 material thickness
13 phase
14 electrical connection line to oscillation coil
15 lack of air flow
16 oscillation coil
$\alpha$ conical opening angle

The invention claimed is:

1. A speaker having a sound radiation direction, comprising:

a basket;

a membrane system having a sandwich-like membrane that becomes thicker from an outside inwards;

an oscillation coil mounted in a center and at a level of the membrane on a support, and wound inwards, with the membrane being connected with the support;

a first centering which centers the membrane in the basket in a first plane;

a second centering which is connected with the support of the oscillation coil which centers the membrane in a second plane via the support; and a symmetrically designed stray field magnet system having two magnets with opposingly-oriented poles and a pole plate centrally placed between the two magnets, wherein:

the stray field magnet system centrally penetrates the membrane, the oscillation coil is at a level of the pole plate in its non-deployed state, and the stray field magnet system is situated in centered fashion to the basket, and a centered lip having a contour that gradually goes from thick on a lower outer edge and adhesive surface, to thinner over a radius and then again to thicker toward an upper inner diameter and adhesive surface, forms a closed and flexible connection between the stray field magnet system and the membrane system.

2. The speaker according to claim 1, wherein the oscillation coil has two electric contacts which are connected with one of the centerings.

3. The speaker according to claim 2, wherein the two electric contacts are interwoven with one of the centerings.

4. The speaker according to claim 1, wherein the centered lip is placed on a main radiation side of the speaker.

5. The speaker according to claim 1, wherein the centered lip has a contour and/or a material thickness that varies.

6. The speaker according to claim 1, wherein the stray field magnet system on at least one side has a phase or a projection on a front side, to which the centered lip is attached.

7. The speaker according to claim 1, wherein a thin copper ring or copper beaker is attached around an outer edge of the pole plate.

8. The speaker according to claim 1, wherein at least one of the centerings is a cup centering.

9. The speaker according to claim 1, wherein a washer made of magnetic material is additionally placed above and below the stray field magnet system in order to homogenize field-line progression and improve field strength.

10. The speaker according to claim 1, wherein individual parts of the stray field magnet system have a centered borehole to facilitate assembly with the aid of an unmagnetizable screw.

11. The speaker according to claim 1, wherein the membrane is rotationally symmetrically shaped and has a conical opening angle of 80° to 95° between its rotational axis and a conical opening relative to its surface in a main direction of radiation.

12. The speaker according to claim 1, wherein the membrane has an inner hollow-cylindrical edge which is connected with a support of the oscillation coil.

13. The speaker according to claim 1, wherein the membrane related to its inner hollow-cylindrical edge is situated at a unilateral offset to the oscillation coil in a direction of carrier frequency alteration of the oscillation coil, but in a range of the oscillation coil.

14. The speaker according to claim 1, wherein the support configured as a hollow cylinder of the oscillation coil has a greater height than an inner hollow-cylinder edge of the membrane.

15. The speaker according to claim 1, wherein the first centering has a sinusoid shape in cross section.

16. The speaker according to claim 1, wherein the second centering has a sinusoid shape in cross section.

* * * * *